US005952593A

United States Patent [19]

Wilder

[11] Patent Number: 5,952,593

[45] Date of Patent: Sep. 14, 1999

[54] REMOVABLE FRETS FOR FRETTED STRINGED MUSICAL INSTRUMENTS

[76] Inventor: Dwain Wilder, 289 Rich's Dugway, Rochester, N.Y. 14625

[21] Appl. No.: 08/886,178

[22] Filed: Jul. 1, 1997

[51] Int. Cl.[6] ..... G10D 3/06

[52] U.S. Cl. ..... 84/314 R; 84/314 R; 84/465; 84/718

[58] Field of Search ..... 84/314 R, 465, 84/718

[56] References Cited

U.S. PATENT DOCUMENTS

| | | | |
|---|---|---|---|
| 4,221,151 | 9/1980 | Barth | 84/314 R |
| 4,723,469 | 2/1988 | Vogt | 84/314 R |
| 4,981,064 | 1/1991 | Vogt | 84/314 R |

OTHER PUBLICATIONS

John Schneider; "A History of the Just Guitar"; Publication: "1/1", vol. 7, No. 3; pp. 11–15.

*Primary Examiner*—William M. Shoop, Jr.
*Assistant Examiner*—Kim Lockett
*Attorney, Agent, or Firm*—Cumpston & Shaw

[57] ABSTRACT

A fretted stringed musical instrument is provided with channels which can removably accommodate frets. In a preferred embodiment of the invention, the channels are provided at locations where it is sometimes, but not always, desirable to have a fret. The frets which are standard to the instrument may remain imbedded in the fingerboard. Alternatively, channels may be provided at all possible fret locations such that the instrument can be played fretted or unfretted. This embodiment would eliminate the need for expensive, time consuming, and instrument damaging refretting operations. In another embodiment of the invention, a set of tempered frets can be used to change the temperament of the instrument, such as from equal temperament to mean temperament in an Appalachian dulcimer. In another embodiment, using frets having a variety of lengths, it also becomes possible to fret only certain strings. Using these embodiments, kits of frets may be provided to a musician wishing to alter the musical mode of the instrument. The removable frets of the present invention can also be used in stringed instruments that have curved fingerboards by employing channels that have a radius of curvature matching that of the fingerboard. A method of providing removable frets to a stringed musical instrument is also described.

19 Claims, 6 Drawing Sheets

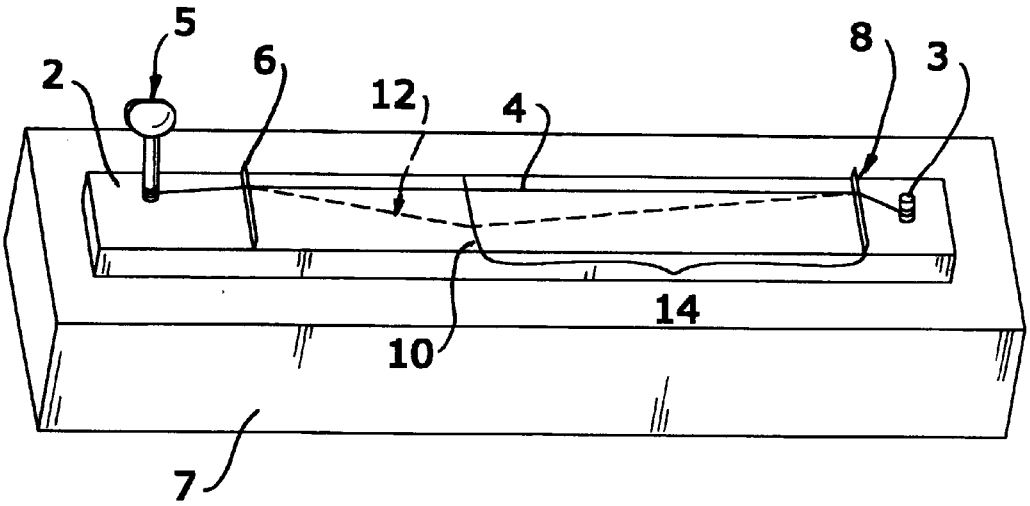
FIG.1
prior art
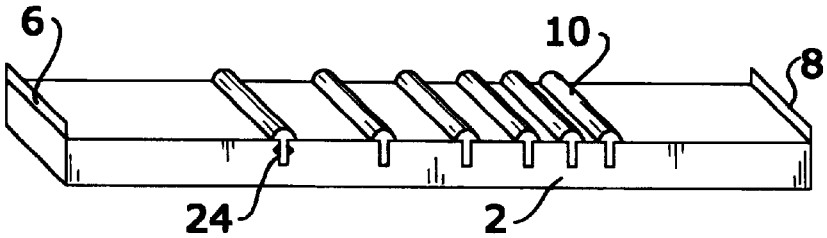
FIG.2
prior art
FIG.3
prior art
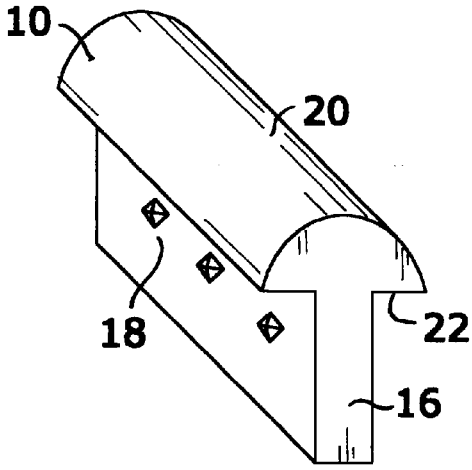

REMOVABLE FRETS FOR FRETTED STRINGED MUSICAL INSTRUMENTS

FIELD OF THE INVENTION

The present invention relates generally to fretted stringed musical instruments, and more specifically relates to channels which are installed in a fingerboard of a stringed musical instrument for allowing frets to be easily removably installed in the fingerboard.

BACKGROUND OF THE INVENTION

Referring to FIGS. 1–3, certain parts of conventional stringed musical instruments which are relevant to the present invention are shown. As shown in FIG. 1, conventional stringed musical instruments are typically equipped with a neck or fingerboard 2 which is used to control the length, and therefore the vibrational frequency of the string 4 being plucked, strummed, bowed, or otherwise activated. The fingerboard 2 may be attached to a resonant box 7. The string 4 is attached to the fingerboard 2 at the hitch pin 3 and its tension is controlled by the tuning peg 5. The string 4 is tensioned between two stops, the nut 6 and the saddle 8. The string 4 is normally activated by plucking with the right hand close to the saddle 8, while the left hand presses the string 4 against the fingerboard 2 near the end terminated by the nut 6.

In the conventional fretted stringed musical instrument, the string length is achieved through the fingers of the left hand pressing down on pieces of wire, the fret 10, imbedded in slots in the fingerboard 2. The string 4, being pressed against the hard surface of the fret 10 and thereby bent (as shown by dashed line 12), is effectively shortened by the amount of distance 14 of the fret 10 to the saddle 8, which defines the effective vibrating length of the string 4, thus altering its pitch (or 'frequency of vibration').

As shown in FIG. 2, representations of typical frets 10 are shown, enlarged for clarity, with respect to the fingerboard 2. In conventional fretted stringed instruments, these frets 10 are wires of a general "T" cross-sectional shape, with the vertical base or tang 16 equipped with barbs 18 and the horizontal top or "crown" 20 being a more or less hemispherical shape, as shown in FIG. 3. The tang 16 is pressed into an imbedding slot 24 cut into the fingerboard 2, where the tang's barbs 18 imbed into the walls of the imbedding slot 24, firmly fixing the fret 10 within the fingerboard 2. The domed crown 20 is thus seated against the surface of the fingerboard 2, where its hemispherical cross-section produces a convenient "curb" against which the string 4 can be firmly and comfortably pressed by the fingers of the player's hand.

These frets 10 as shown in FIGS. 2 and 3 are firmly fixed so that their function can be reliable. They are removed only with great difficulty when they are so worn by use that they must be replaced with new frets in order to play the instrument accurately and precisely. Removal of the frets is difficult because the barbs 18 tear through the wood of the fingerboard 2. Before the frets 10 can be replaced, the wood of the fingerboard 2 needs to be repaired. When the frets 10 are replaced, they typically need to be glued in which makes the next replacement procedure even more difficult. This refretting operation can easily cost over $150, takes a skilled instrument maker, and is time consuming. In addition, because the frets 10 are essentially immovable without time, repair, and expense, they cannot be removed and replaced at the fancy of a musician desiring to experiment with different implementations.

A typical dulcimer instrument is shown in FIG. 4. The fingerboard 2 of FIG. 1 is installed upon resonant box 7. Three strings 4 are shown, first string 201, second string 202, and third string 203, although more or less strings may be utilized. The resonant box 7 is provided with sound holes 206 and a peg head 208 supports the tuning pegs 5. The fingerboard 2 is provided an indent called a strum hollow 210 which is located towards the end defined by the saddle or bridge 8. The length defined by the location of the bridge 8 and the nut 6 is the string vibrating length 212. The effective vibrating length of a string is shortened when a string is pressed against the hard surface of a fret, as shown by length 14 in FIG. 1. The dulcimer of FIG. 4 is shown occupied by a number of frets 10. As the positioning of most frets are standard, a detailed discussion will not be provided. FIG. 4 is shown with an "extra fret" 214 installed at the 6½ position. The installation of "extra frets" has been a much debated subject. Frets have only previously been able to be installed on a substantially permanent basis, and removal of these frets would require significant repair of the fingerboard, costing the musician a significant amount of time and money. The dulcimer is a diatonic instrument, unique in American music. Yet a musician often wants to play something with sharps or flats which can't be reached easily. If the diatonic fretboard is populated with more and more "extra frets" there is risk of losing contact with the charm of the modal music so natural to the dulcimer.

Thus, there is a need for a replaceable fret which can be removed and replaced by the musician himself. There is further the need for a fingerboard which can accept an easily replaceable fret. There is also the need for a fingerboard which affords a musician greater flexibility with experimentation by allowing him or her to easily replace, remove, and/or interchange frets in different locations. There is also the need for a fingerboard which can easily accept different types of frets without permanently changing the instrument.

SUMMARY OF THE INVENTION

The frets of the present invention can be inserted and removed quickly and easily. This new development in fret technology makes it possible to enhance a diatonic fretboard—even completely reconfigure it if desired. Extra frets can be inserted as needed for a performance set, an unexpected key change during a jam session, or to try an innovative arrangement that requires some little-used half-frets in the key best suited to the musician's voice. The frets of the present invention may be just like conventional frets, except they can be easily inserted and removed, using a fingernail or an insertion tool.

With frets of the present invention installed in favorite half-fret places, a musician can have them available when desired, without having them as a distraction when they aren't needed. The integrity of the dulcimer as a modal, diatonic musical instrument is preserved, but the present invention provides the flexibility of having the accidental sharps and flats occasionally needed, on the strings that need them.

In the novel system described here, the frets are removable and replaceable at will, and furthermore are designed to be inserted and removed from moment to moment, according to the needs of the player to change the pitch of the instrument in various patterns (such as a "diatonic" pattern versus a "chromatic" pattern).

A somewhat wider slot is cut into the fretboard as previously described, only in this instance it is large enough to accommodate a channel. This channel may be a square metal box with open ends cut to length so that it extends the width of the fingerboard and flush with its top surface and sides. Into the top surface of the channel which is flush with the surface of the fingerboard is supplied a slot. This slot is of a width to accommodate the tang of the fret as described above. Furthermore, the depth and width of the interior of the channel are supplied such that there is room to accommodate the full depth of the fret's tang and the full width of the tang's barbs.

In playing use, the fret, being installed in the channel instead of directly into an imbedding slot in the fingerboard, functions in a manner completely identical to the functioning of the fret as installed in the conventional fingerboard. However, by pressing on the end of the tang of the fret or otherwise grasping it, it can be slid out of the slot. The frets used can be conventional frets, or may be specially designed with dovetail ribs, for example.

Furthermore the fret can be placed elsewhere, in another empty slot or the same slot, by sliding the tang into the slot so that the bottom of the crown is flush with the channel as described above. Furthermore, the fret can be left out entirely and the instrument played without it, the slot left by its absence being so narrow as not to afford appreciable impediment to the fingers of the hand as they move along the surface of the fingerboard in route to their next playing position.

In one alternate embodiment, the fingerboard can be completely configurable, that is, provided with a channel at every fret location. In another embodiment, the fingerboard can be provided with a combination of imbedded frets and removable frets. In another embodiment, a musician may use a set of frets for providing a temperament different than the temperament defined by the distances between the fret slots. These frets preferably have crowns which are offset from their tangs. In another embodiment, frets are disclosed which do not extend the full width of the channel for selectively fretting a string or a select number of strings. In yet another embodiment, channels are disclosed which have a radius of curvature substantially the same as a curved fingerboard for removably accommodating curved frets. Kits for reconfiguring the fingerboard of a fretted stringed musical instrument are also disclosed.

BRIEF DESCRIPTION OF THE DRAWINGS

FIG. 1 is a perspective view of a prior art fingerboard.

FIG. 2 is a perspective view of a prior art fingerboard with imbedded frets.

FIG. 3 is a perspective view of a prior art fret.

DETAILED DESCRIPTION OF THE PREFERRED EMBODIMENTS

Figure 4:
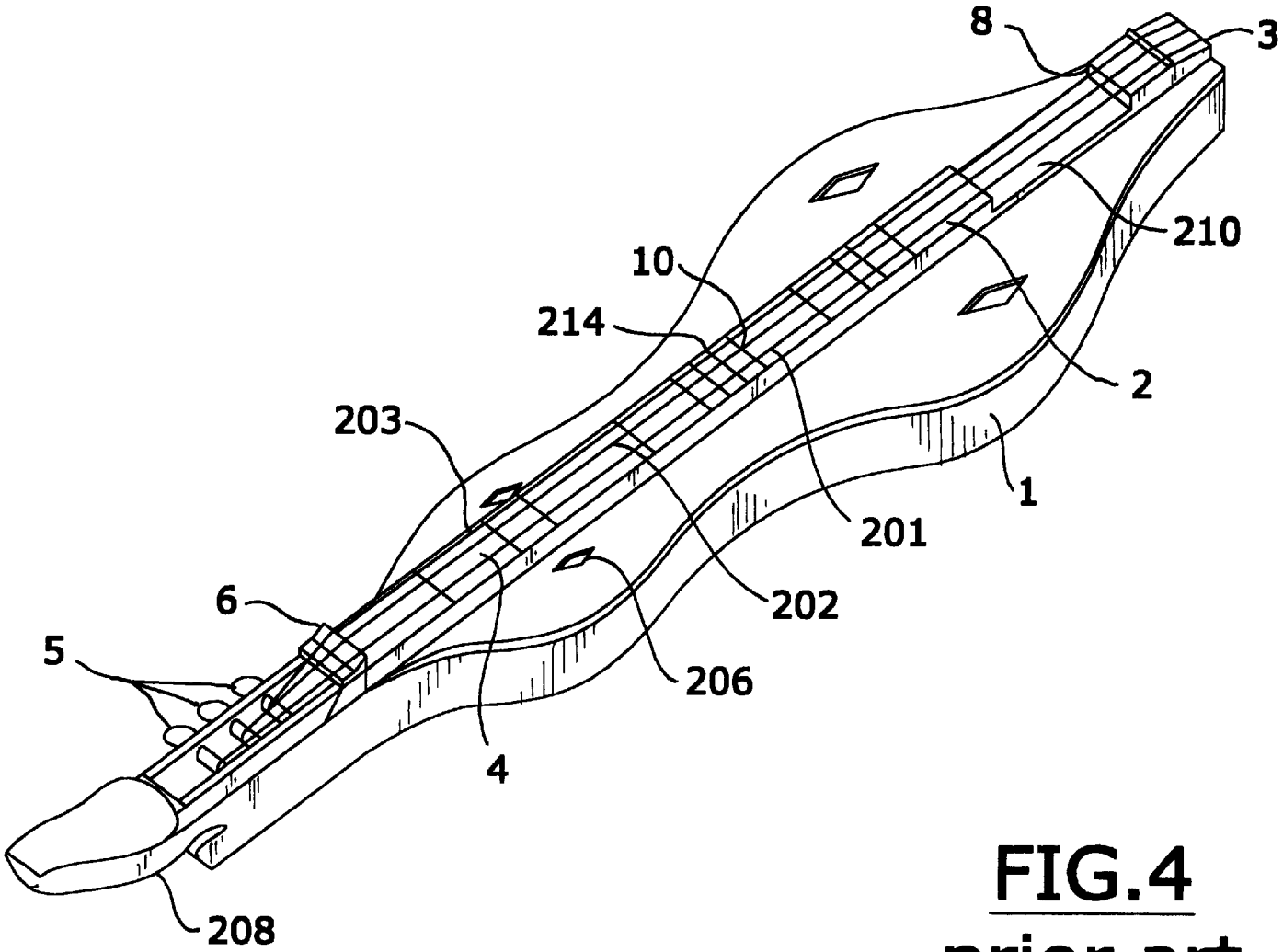
FIG.4 prior art
FIG. 4 is a perspective view of a prior art dulcimer shown with an extra fret installed in the fingerboard.
Figure 5:
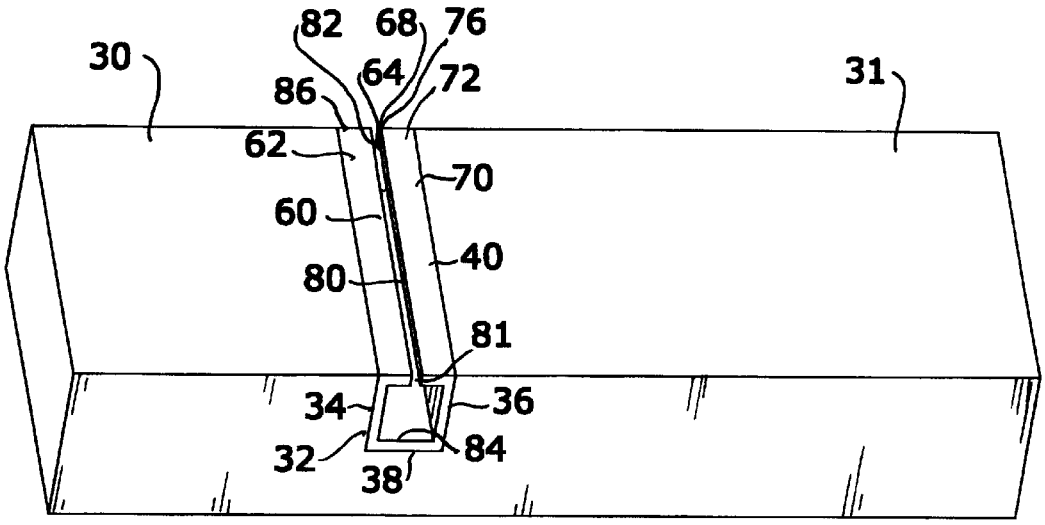
FIG. 5 is a perspective view of a channel installed in a fingerboard in one embodiment of the present invention.

Turning now to FIG. 5, a preferred embodiment of a fingerboard 30 is shown. The fingerboard 30 may be equipped with a nut, saddle, and strings as in a conventional stringed musical instrument as shown in FIGS. 1–2. The fingerboard 30, however, is preferably provided with at least one channel slot 32 which is greater in width than an imbedding slot 24. That is, the channel slot 32 takes up more space on the fingerboard 30 than does the imbedding slot 24. The channel slot 32 may have a substantially U-shaped cross-section with square corners. Other shapes are possible, however the U-shaped cross-section with square corners is quite simple to mill. The channel slot 32 as shown in FIG. 5 is thus provided with two parallel side walls 34 and 36 and a bottom wall 38. Within the channel slot 32, there is inserted a correspondingly shaped channel 40. The channel 40 shown in FIGS. 5 and 6 has a substantially square cross-sectional shape having two side walls 42 and 48, a bottom wall 54, and a top wall 60. The side wall 42 preferably has an inner wall 44 and an outer wall 46. Likewise, the side wall 48 preferably has an inner wall 50 and an outer wall 52, and the bottom wall 54 preferably has an inner wall 56 and an outer wall 58. The channel 40 is most simply cut from a piece of square shaped tubing. A fret slot 80 is then cut substantially through the center of the top wall 60. Thus, the top wall 60 is cut into a first top wall 62 and a second top wall 70. The first top wall 62 has an outer wall 64, an inner wall 66 and a cut wall 68 facing the second top wall 70. Likewise, the second top wall 70 has an outer wall 72, an inner wall 74, and a cut wall 76 facing the first top wall 68. The fret slot 80 spaces the cut wall 68 from the cut wall 76.

When the channel 40 is placed in the channel slot 32, the outer wall 46 of the side wall 42 of the channel 40 is adjacent to the side wall 34 of the channel slot 32; the outer wall 58 of the bottom wall 54 of the channel 40 is adjacent to the bottom wall 38 of the channel slot 32; and the outer wall 52 of the side wall 48 of the channel 40 is adjacent to the side wall 36 of the channel slot 32. When the channel 40 is placed correctly in the channel slot 32, the first top wall 62 and second top wall 70 of the top wall 60 of the channel 40 are preferably flush with the top surface 31 of the fingerboard 30.

The channel 40 is further provided with at least one open end 84, and is preferably provided with a second open end 86. In one embodiment, the fret slot 80 preferably extends from the first open end 84 to the second open end 86 with a first end 81 of the fret slot 80 adjacent the first open end 84 and a second end 82 of the fret slot 80 adjacent the second open end 86.

Although the channel 40 has been described in detail as having a square cross-sectional shape, it is well within the scope of this invention to provide channels and correspondingly shaped channel slots having alternative cross-sections. For example, nearly any polygonally shaped tubing could be used to form the channels, however, one side would have to lay flush with the top surface 31 of the fingerboard 30 so as not to interrupt the fingerboard surface, and the channel slot would have to be cut to accept the polygonal shape. If cylindrically shaped tubing is chosen, then it would be preferable to flatten any section extending above the surface 31 of the fingerboard 30.

Figure 6:
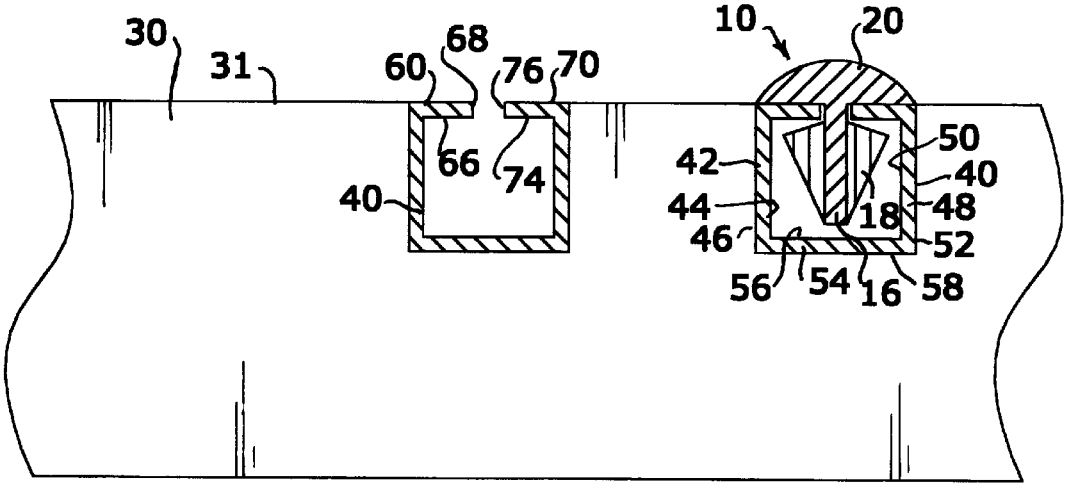
FIG. 6 is a side cross-sectional view of a channel and a fret inserted in a channel in one embodiment of the present invention.

Turning now to FIG. 6, a fret 10 is shown installed in a channel 40. The fret 10 is inserted into either open end 84 or 86 of the channel 40 such that the lower surface 22 of the crown 20 is adjacent the outer walls 64 and 72 of the first and second top walls 62 and 70, respectively, and the tang 16 is between the cut walls 68 and 76. The barbs 18 preferably fit snugly between the inner walls 44 and 50 of the side walls 42 and 48 of the channel 40. Thus, a conventional fret 10 is retained within the channel 40, yet is simply removable without requiring the expertise, expense, or time of a skilled instrument maker.

Figure 7A:
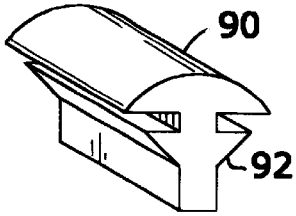
FIG. 7A is a perspective view of a fret in an alternate embodiment of the present invention.
Figure 7B:
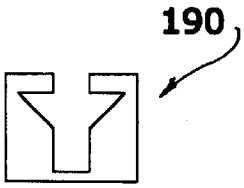
FIG. 7B is a front view of a channel for use with the fret of FIG. 7A.

One advantage to employing the channel 40 of the present invention is that conventional frets 10 may be utilized, thus eliminating the need for the consumer to locate specially designed frets. Alternatively, as shown in FIG. 7A, specially designed frets 90 for use with the channel 40 may be provided. As opposed to employing barbs 18, these frets use channel engaging ribs 92 which extend the full length of the frets 90. As opposed to frets 10, frets 90 may be more easily inserted within the channels 40, and may actually be less expensive to produce because the mold would be simpler to make (the cost of additional material would be negligible given the small size of the fret). If desired, specially designed channels 190 shown in FIG. 7B could be used which have a female cross-section corresponding to the male cross section of frets 90, in this case a dovetail cross section.

Figure 8:
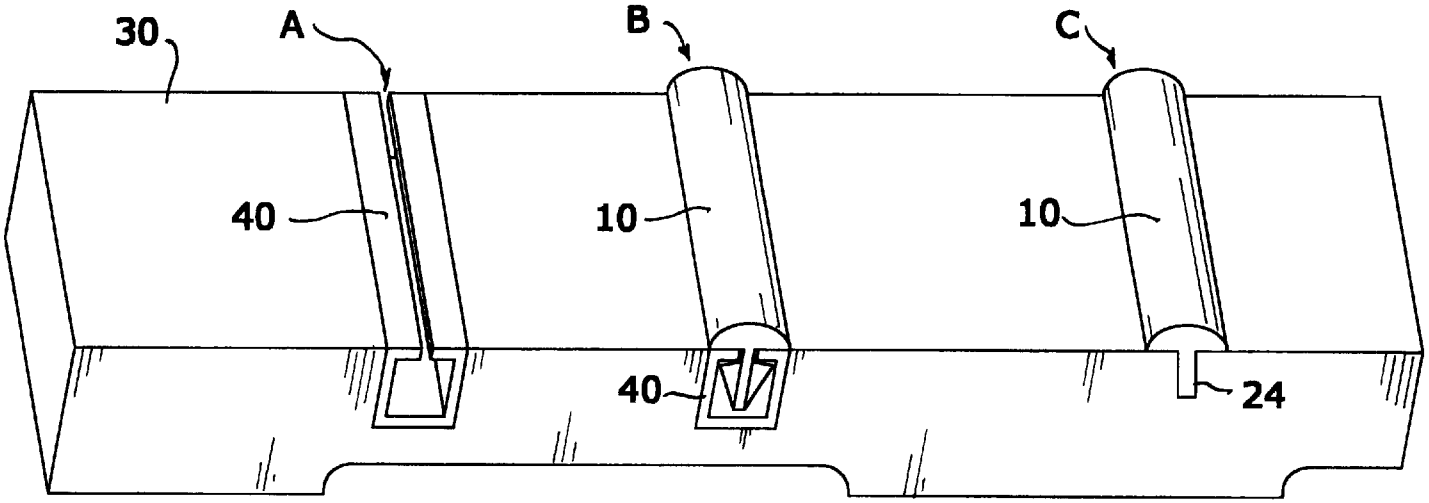
FIG. 8 is a perspective view of a channel, a fret inserted in a channel, a fret all placed in a fingerboard of the present invention.

More than just providing a simple and cost effective means for replacing frets, the channel 40 of the present invention enables a musician to choose whether or not a fret will be used at certain positions of the scale. Channel slots and channels can be provided at any of the scale positions, and elsewhere if desired, without affecting the permanent status of the musical quality of the instrument. A musician may then experiment with frets inserted at selected positions to alter the sounds of the stringed instrument. For example, a fingerboard 30 may be provided with channel slots at the most likely locations of fret installation and removal, however, additional channel slots may be milled at any location into any fingerboard at a musician's request to provide greater flexibility. Alternatively, an instrument can be equipped totally with removable frets (i.e. no imbedded frets) such that the instrument can be played as a fretted or un-fretted instrument. As shown in FIG. 8, an instrument may be equipped with a combination of removable frets and imbedded frets. The fret 10 imbedded in the instrument at location C is substantially permanently imbedded in an imbedding slot 24 in the fingerboard 30. This is a fret that the musician will always wish to have installed. Channels 40 are provided at locations A and B where extra frets may be desired, or in standard fret locations where a musician may want to occasionally remove a fret. If a fret is removed from the channel 40, as shown at location A, the top surface 31 of the fingerboard 30 is substantially smooth and uninterrupted, and the fret slot 80 is narrow enough so as to not change the sound coming from the instrument.

Figure 9B:
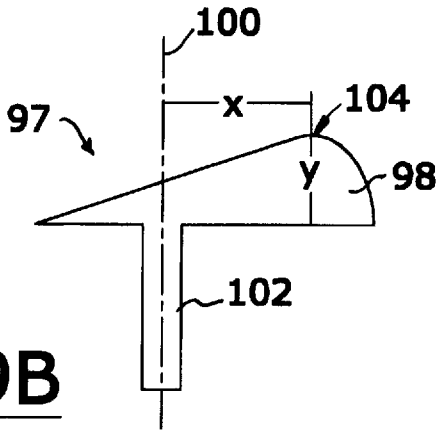
FIG. 9B is a front view of a tempered fret.
Figure 9A:
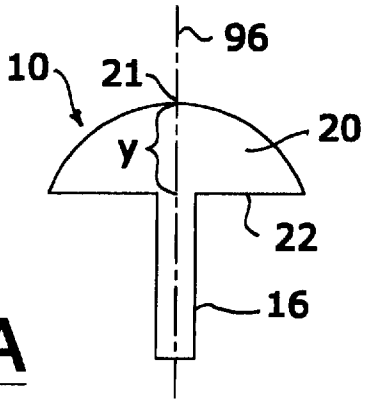
FIG. 9A is a front view of a conventional fret.

In addition to providing a musician with an endless array of musical alternatives with conventional frets, a system of tempered frets may also be provided. As shown in FIG. 9A, a conventional fret has a hemispherical crown 20 as previously described. The tang 16 of the conventional fret which has a centerline 96 divides the crown 20 into two equally sized halves. An uppermost point 21 of the fret 10 is located along the centerline 96. A tempered fret 97 shown in FIG. 9B, on the other hand, has a crown 98 which is not divided by the centerline 100 of its tang 102. An uppermost point 104 of the crown 98 of the tempered fret 97 is not located along the centerline 100, and is instead offset from the centerline 100. Although a specific embodiment of a tempered fret is shown, the upper most point 104 could lie the right or left of the centerline 100 and could extend any distance "x" from the centerline 100. It is preferable that the distances "y" from the lower surfaces 22 and 99 of the crowns 20 and 98, respectively, be substantially equal. The tangs 16 and 102 are preferably identical, so that both types of frets will fit equally as well in the channels 40 as they would in conventional imbedding slots. Although both tangs may be provided with either barbs 18 or ribs 92, they are not shown in FIGS. 9A and 9B for clarity.

Using these tempered frets, it becomes possible for the dulcimer instrument to be in mean temperament rather than equal temperament. A musician can, using the present invention, experiment with mean temperament music and intriguing exotic temperaments rather than settling for the scale temperament inherent in the instrument. Installing frets with offset tangs in a configurable fretboard would alter the tempering of the instrument's scale. With this capability, a musician can try out all those alternate musical scales, opening up access to non-western musical modes and exotic repertoires for the Appalachian Dulcimer as well as other fretted stringed musical instruments.

The conventional fingerboard is fitted for frets according to a specifically "tempered scale." Such "tempered scales" accommodate the non-linear relationship between musical intervals. The most well-known of these tempering systems is "equal temperament" which is the basis for tempering the scale used in almost all western music.

However, there are several other schemes of tempering musical scales, and they all deviate from the "mean" or untempered scale by small but decisive amounts.

The system of removable and replaceable frets of the present invention may be used to accommodate many of these tempering systems without the necessity of changing the intervals between the channels which carry the frets. By producing tempered frets as described with respect to FIG. 9B which have crowns whose highest point is offset from the tang by calibrated amounts, the small deviations between the tempering scheme (defined by the distances between the centerlines of the channel slots) and another desired temper can be compensated. Thus a set of tempered frets can be used to temporarily convert a fingerboard from "equal" temperament to, for instance "mean" temperament, and so on.

Figure 10A:
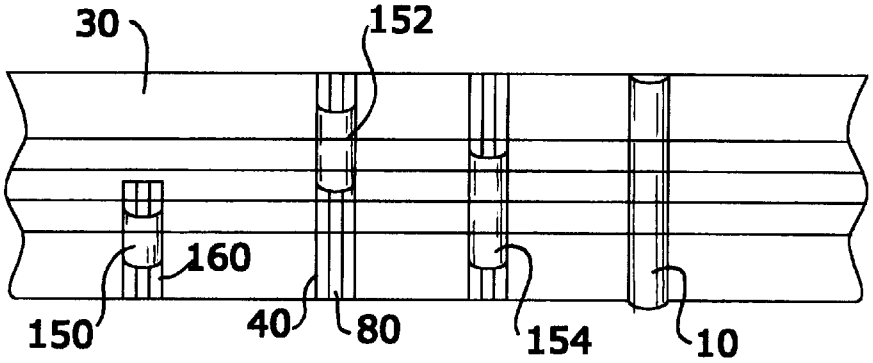
FIGS. 10A and 10B are top views of frets of various lengths inserted into channels in a fingerboard of the present invention.
Figure 10B:
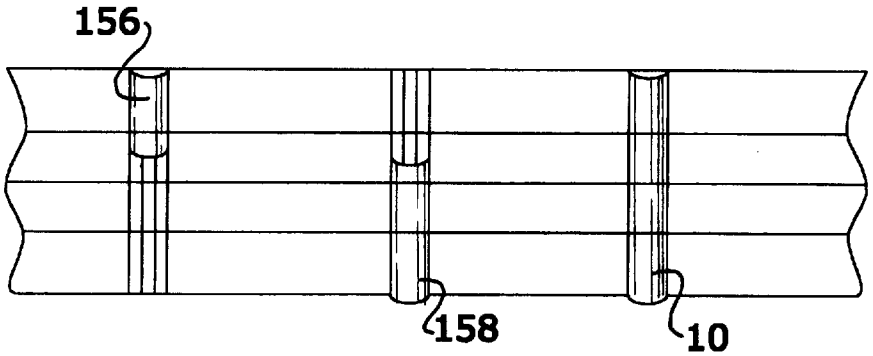

The conventional frets 10 and tempered frets 97 up until now have been described as full width frets which would extend the length of either an imbedding slot 24 or a channel 40. Because of the flexibility afforded by the present invention, however, a musician is not limited to the standard length fret previously employed in stringed fretted musical instruments. Normally, a fret extends the width of the fingerboard. Because the frets of the present invention may be easily removed and replaced, frets may be used which are shorter than the width of the fingerboard. Using these "partial width" frets, a musician may have frets under some strings but not others. As shown in FIGS. 10A–10B, frets may be provided in a variety of widths, not limited to the examples shown. FIG. 10A shows a four string instrument fitted with a quarter width fret 150 for fretting any one string; a half-width fret 152 for fretting any two strings; a three quarter width fret 154 for fretting any three strings; and a full width fret 10 for fretting all strings. FIG. 10B shows a three string instrument fitted with a one-third width fret 156 for fretting any one string; a two-third width fret 158 for fretting any two strings; and a full width fret 10 for fretting all strings. The frets can be slidable within the channels for proper positioning below selected strings, but provided with a friction fit with the channels such that they do not move about during play. In addition, although channels 40 which extend the full width of the fingerboard 30 would be desired in most applications for the greatest flexibility, channels may be used which are shorter in length if it is determined that only a select number of strings will ever wish to be fretted. Thus, as shown in FIG. 10A, shorter channel 160 may be used which can accommodate a quarter width fret 150 as shown or a half width fret 152 for fretting either or both strings under which channel 160 resides.

Figure 11:
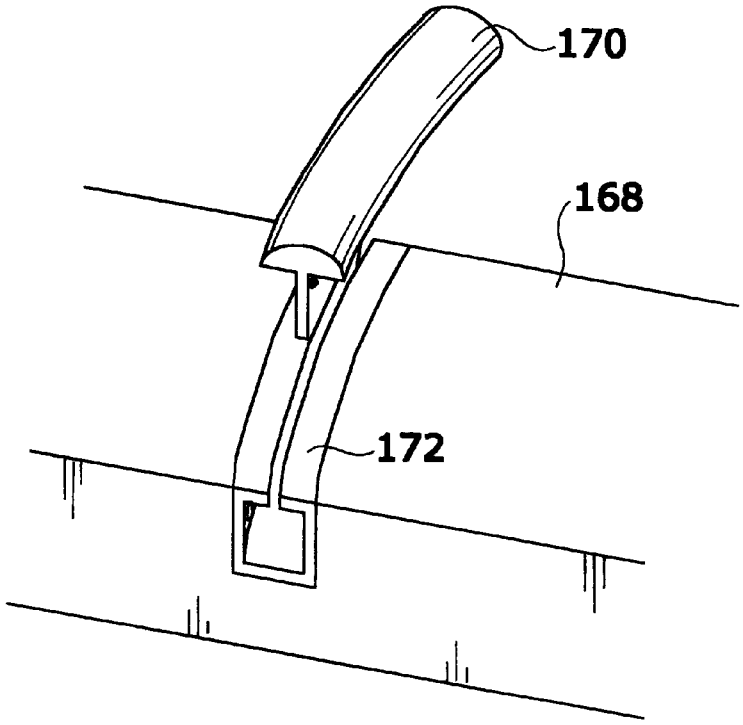
FIG. 11 is a perspective view of a curved fret inserted in a curved channel in a curved fingerboard in another embodiment of the present invention.

As shown in FIG. 11, many fretted stringed musical instruments have fingerboards 168 curved in a transverse direction. The removable frets of the present invention may be adapted to fit these instruments. Standard frets 170 which are curved for use with curved fingerboards may be used, or alternatively, specialized frets such as that shown in FIG. 7 may be curved to fit the fingerboards curvature. A channel 172 can be curved to fit the surface of the curved fingerboard 168. The channel 172 and fret 170 are preferably arched to substantially the same radius as the radius of the arched cross-section of the curved fingerboard 168. In one embodiment, the curved fingerboard can be provided with only removable frets such that the instrument can be played with or without frets. The curved fingerboard 168 may be provided with tempered frets, also arched to the same radius as the radius of the arched cross-section of the curved fingerboard, such that, as with tempered frets in a flat fingerboard, a resulting fret pattern is tempered differently than the temperament determined by the distance between the channel slots. Also, a variety of lengths of curved frets and/or curved channels may be provided for fretting only select strings as described with respect to FIGS. 10A–10B.

Figure 12:
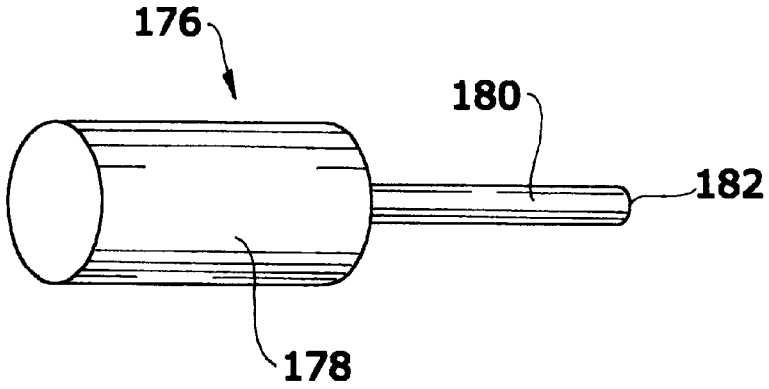
FIG. 12 is a side view of an insertion/removal tool of the present invention.

For easy removal of the removable frets from the channels of the present invention, a fret insertion/removal tool 176 shown in FIG. 12 may be used. Although it is simple to insert a full length fret 10 into a channel 40 of the present invention from either of the open ends 84 and 86, removal of the full length fret may require a musician to use a small finger or finger nail to push the fret 10 out of the channel 40. Alternatively, the musician can hold onto handle 178 of the tool 176, abut the distal end 182 of the stem 180 against the end of the fret 10, and push on the fret 10 with the stem 180 until an easily graspible portion of the fret 10 becomes exposed outside of the channel 40. Shorter length frets such as those shown in FIGS. 10A and 10B are also easy to insert, but some musicians may prefer to use the fret insertion/removal tool 176 for precise placement of the shorter length frets underneath the selected strings, and for subsequent removal.

The frets described in the present invention may be sold individually to a musician who owns a fingerboard outfitted with the channels of the present invention. The musician's fingerboard may either be purchased with the channels or retrofitted with the channels. Alternatively, the frets and associated items may be sold in kits. For example, a standard kit may include a quarter-width fret, a half-width fret, a two-third-width fret, a three-quarter-width fret, and a full-width fret. A maintenance kit may include two spare frets of each width described in the standard kit, an insertion/removal tool, pipe-cleaners for cleaning, and a handy carrying case. An extra frets kit may include the frets of the present invention installed at any fret location chosen by the musician. A first register kit may include frets of the present invention installed at all half-frets through 10½. A chromatic kit may include frets of the present invention installed at all half-frets on the fretboard. A configurable fretboard kit may include frets of the present invention at every semitone on the fretboard.

The above described kits may be used to turn the diatonic dulcimer instrument, for example, into an instrument with endless possibilities. For instance, choosing the first register kit, a musician can have any half-fret in the first octave (and a little beyond, to 10½). With the first register kit, you can play almost any key from almost any tuning. Using a tuning of CGC, to play in D major, a musician would install frets of the present invention at 3½ and 7½ and capo at the first fret; to play in E flat, a musician would install frets of the present invention at 4½ and 8½ and capo at the 1½ fret; to play in E, a musician would install frets of the present invention at 3½,4½, 6½, 7½ and 8½ and capo at the second fret. A musician could also slide in quarter-width frets under the third string at every half-fret, giving him or her a chromatic bass line while the melody remains modal. With the chromatic kit, a musician could install all of the frets in the kit and play chromatically into the second octave, all the way up the fretboard; the musician would need only remove the frets to return to modal play. With the configurable fretboard kit, a musician could play in any mode starting at the open string, by shifting the whole diatonic pattern up or down the fretboard. The musician would no longer have to use a capo (and accept the accompanying key change) to play in a different mode. Likewise, a musician could play in any key without a capo or changing mode, by shifting the diatonic pattern up and down the fretboard. Another idea involves installing frets of the present invention at each semi-tone and playing chromatically. If a musician needs a shorter scale length for a piece, he or she could install a full-width fret at the 0½ or 1st fret, capo behind it, and shift the diatonic fret pattern down to have a fretboard which is shorter. The Scheitholt had frets under one or two strings, leaving the other strings as drones. With the configurable fretboard kit, a musician could reincarnate the Scheitholt on his or her own Appalachian Dulcimer.

An instrument, such as the dulcimer, equipped totally with the removable frets of the present invention, (that is, without any imbedded frets), can be played in a diatonic manner in any mode. Modes are alternate manners of dividing up the half-steps and whole-steps in the diatonic scale. The conventional tone names "do re mi fa so la ti do" describe the diatonic scale, with half-steps between mi-fa and la-ti, and is the major mode. By beginning the scale at tones other than "do", other scale modes result. Thus, a dulcimer can be configured to play in different modes starting from the open string.

With any of the above-described embodiments, when a removable fret of the present invention wears out, a musician need only install a spare and keep playing.

While the invention has been described in connection with presently preferred embodiments thereof, those skilled in the art will recognize that many modifications and changes may be made therein without departing from the truth and scope of the invention, which accordingly is intended to be defined fully by the appended claims.

I claim:

1. A removable fret system for a fretted stringed musical instrument comprising:

an elongated fingerboard having a plurality of transverse channel slots cut across the width of the fingerboard;

a channel with at least one open end inserted into each channel slot, each channel having an exterior and an interior, a top side of the exterior is flush with the fingerboard;

a fret slot cut in the top side parallel to the channel slot, the fret slot having a width; and a fret removably inserted into at least one channel, a portion of the fret within the channel having a width greater than the fret slot width, each occupied channel containing a single fret.

2. The removable fret system according to claim 1 wherein the channel is made from substantially square tubing having four sides with the fret slot cut in one side.

3. The removable fret system according to claim 2 wherein the channel has two open ends and the fret can be inserted into and removed from the channel from either of the two open ends and cannot be removed from the channel through the fret slot.

4. The removable fret system according to claim 3 further comprising a fret removal tool having dimensions sized to fit within the channel from either of the two open ends.

5. The removable fret system according to claim 1 wherein the fret comprises a crown, a tang, and at least one barb protruding from the tang, and the fret, when installed in the channel, is removably held within the channel by a portion of the channel which is positioned between the crown and the at least one barb.

6. The removable fret system according to claim 5 wherein the at least one barb is a pair of dovetail ribs.

7. The removable fret system according to claim 1 wherein the fret comprises a crown, a tang, and at least one barb on the tang, wherein the fret when installed in the channel has a lower side of the crown adjacent the top side of the exterior of the channel, a top side of the at least one barb adjacent a top side of the interior of the channel, and a lower end of the tang adjacent a bottom side of the interior of the channel.

8. The removable fret system according to claim 1 further comprising a plurality of frets, wherein some of the frets are provided with a crown having a hemispherical cross-section.

9. The removable fret system according to claim 8 wherein each fret has a crown and a tang having a centerplane, wherein some of the frets are provided with a crown which has a peak offset from the centerplane of the tang.

10. A stringed musical instrument comprising:

an elongated fingerboard having a plurality of transverse channel slots cut across the width of the fingerboard;

a channel with at least one open end substantially permanently inserted into each channel slot, the channel having an exterior and an interior, a top side of the exterior is flush with the fingerboard;

a fret slot cut in the top side parallel to the channel slot so that the channel is adapted to removably and securely hold a fret to the fingerboard and prevent removal of the fret from the channel through the fret slot, the fret slot having a width.

11. The stringed musical instrument of claim 10 wherein the instrument is an Appalachian dulcimer.

12. The musical instrument of claim 11 comprising a plurality of channels, each channel having a fret slot, the channels located at positions along the fingerboard for accommodating frets for playing the dulcimer in a temperament defined by distances between fret slots in the channels.

13. The musical instrument of claim 12 comprising a plurality of frets with offset tangs for removable insertion into the plurality of channels for playing the dulcimer in a temperament different than the temperament defined by the distances between the fret slots in the channels.

14. The stringed musical instrument of claim 10 wherein the fingerboard has a radius of curvature greater than zero, and the channel has a radius of curvature which substantially matches that of the fingerboard.

15. The stringed musical instrument of claim 10 further comprising a fret removably inserted in the channel, a portion of the fret within the channel having a width greater than the fret slot, each occupied channel containing a single fret.

16. The stringed musical instrument of claim 15 wherein the fingerboard has a width, the channel has a length which is substantially equal to the width of the fingerboard, and the fret has a length which is substantially shorter than the length of the channel for fretting a select number of strings.

17. The stringed musical instrument according to claim 11 further comprising a plurality of removable frets.

18. The stringed musical instrument according to claim 17 further comprising a plurality of imbedding slots in the fingerboard with a fret substantially permanently imbedded in each bedding slot.

19. A method of installing easily removable frets in a fretted stringed musical instrument comprising the steps of:

providing a fingerboard having a width for accommodating frets and a length for at least partially defining a vibrating length of a string;

cutting a channel slot across the width of the fingerboard, the channel slot having a width which is wider than an imbedding slot for a fret;

inserting a channel in the channel slot, a top of the channel being flush with the fingerboard, the channel having at least one open end and a fret slot cut through the top of the channel; and inserting a single fret through the at least one open end in the channel so that a portion of the fret having a width greater than the fret slot is within the channel.

* * * * *